US005819834A

United States Patent [19]

Wedekind

[11] Patent Number: 5,819,834

[45] Date of Patent: Oct. 13, 1998

[54] DOOR ASSEMBLY WITH IMPROVED SUPPORT SYSTEM

[75] Inventor: Gary A. Wedekind, Amboy, Ill.

[73] Assignee: Raynor Garage Doors, Dixon, Ill.

[21] Appl. No.: 616,445

[22] Filed: Mar. 15, 1996

[51] Int. Cl.[6] ..... E05D 15/26

[52] U.S. Cl. ..... 160/209

[58] Field of Search ..... 160/209, 201, 160/181, 207, 233, 234, 182; 52/71, 127.2, 291, 720.3

[56] References Cited

U.S. PATENT DOCUMENTS

| | | | |
|---|---|---|---|
| 2,966,212 | 12/1960 | Fimbel | 160/201 X |
| 3,104,699 | 9/1963 | Wolf et al. | 160/201 X |
| 3,265,118 | 8/1966 | Smith | 160/209 |
| 3,424,223 | 1/1969 | Rosenblatt | 160/209 |
| 3,443,625 | 5/1969 | Moser et al. | 160/209 X |
| 3,516,474 | 6/1970 | Pemberton et al. | 160/209 |
| 4,589,420 | 5/1986 | Kendall et al. | 52/309.11 |
| 5,046,544 | 9/1991 | Coluccio | 160/209 X |
| 5,383,509 | 1/1995 | Gaffney et al. | 160/209 |
| 5,445,207 | 8/1995 | Romanelli et al. | 160/209 |

*Primary Examiner*—David M. Purol

*Attorney, Agent, or Firm*—Tilton, Fallon, Lungmus & Chestnut

[57] ABSTRACT

A door assembly having articulated segments includes at least one support assembly for bracing the door assembly against lateral forces. This support assembly includes guide members secured to the door segments and articulated locking members disposed in sliding relation with the guide members. The locking members move between a first predetermined position in which they allow the door segments to pivot with one another and a second position in which they bridge the door segments and prevent them from pivoting with one another.

16 Claims, 3 Drawing Sheets

DOOR ASSEMBLY WITH IMPROVED SUPPORT SYSTEM

BACKGROUND OF THE INVENTION

1. Field of the Invention

This invention relates generally to overhead door assemblies and, more particularly, to overhead door assemblies with supports which resist lateral loads such as wind loads and other such loads acting on the door when the door lies in a closed or lowered position.

2. Description of the Prior Art

Overhead door assemblies, e.g., garage doors, generally include articulated door segments and guide and support track assemblies which support the door in a raised position and in a lowered position where it closes an opening in a wall. Rollers mounted to edge portions of the door connect the door to a track assembly and allow the door to move between the two positions.

Manufacturers of those prior door assemblies have designed them to withstand loading by normal forces. However, certain areas experience higher than normal forces from the elements. For example, in certain coastal areas, hurricanes and other such disturbances generate winds that move at extremely high velocities. The forces from those winds damage conventional door installations by breaking the door, bending the support track, or bending the stems of the rollers.

One solution to the problem identified above is to provide door assemblies with supports that brace the door to withstand larger forces. The prior art includes a variety of such supports; but they typically comprise complex structures with removable components and require an operator to manually lock the bracing members and the door segments together with pins or similar devices.

The present invention provides a solution without the disadvantages of the prior art structures. It automatically moves into a locked position when the door moves to a lowered position and an unlocked position when the door moves from a lowered to a raised position. The door assembly of the present invention includes a simple and durable construction that allows a standard door assembly to withstand heavy loading.

SUMMARY OF THE INVENTION

In accordance with one embodiment of this invention, a door assembly includes articulated door segments for opening and closing an opening in a wall member. The articulated door segments lie disposed in end to end relation, movable between raised and lowered positions to open or close the opening. One or more support assemblies extend across the door segments to brace the door assembly when it lies in a lowered position. Each support assembly includes: a plurality of guide members disposed in spaced end-to-end relation and a plurality of articulated locking members disposed in end-to-end relation with each other and in sliding relation with the guide members. Each guide member lies secured to a separate door segment.

Positioning means places and maintains the locking members into a first predetermined position to allow the door segments to pivot in relation to one another as the door assembly moves from a lowered to a raised position. This positioning means also places and maintains the locking members in a second predetermined position in which each locking member bridges adjacent door segments, a door segment and the wall member, or a door segment and any other structural member, e.g., a floor or a base.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representations, and fragmentary views, in part, illustrate the embodiment. In certain instances, the disclosure may not include details which are not necessary for an understanding of the present invention, such as conventional details of fabrication and assembly.

DETAILED DESCRIPTION OF THE DRAWINGS AND AN EMBODIMENT

Figure 1:
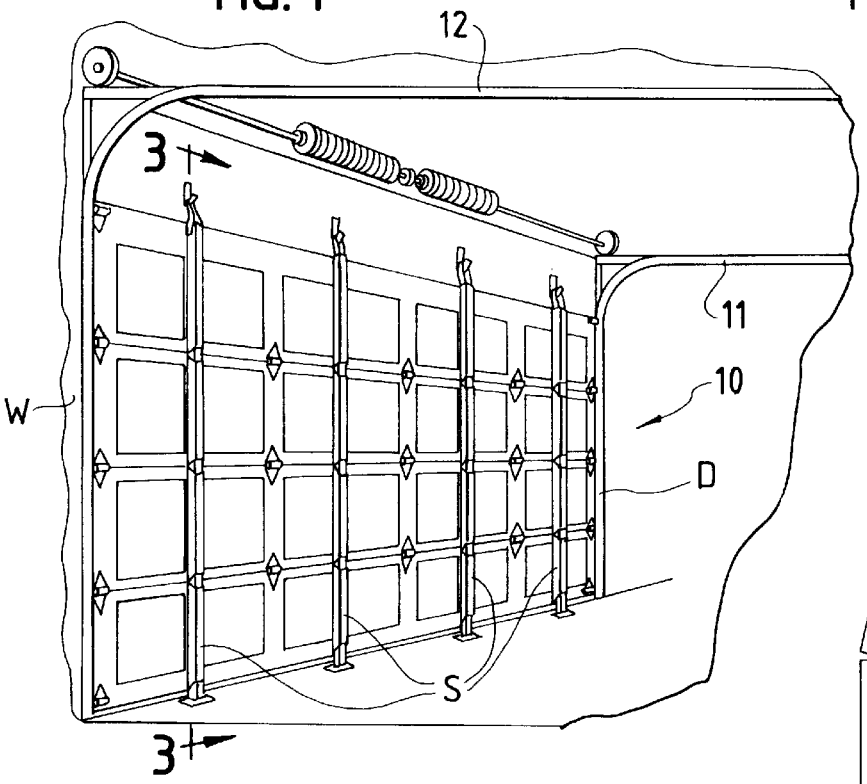
FIG. 1 is a perspective view of the overhead door assembly of the present invention, showing the assembly in a lowered position.
Figure 2:
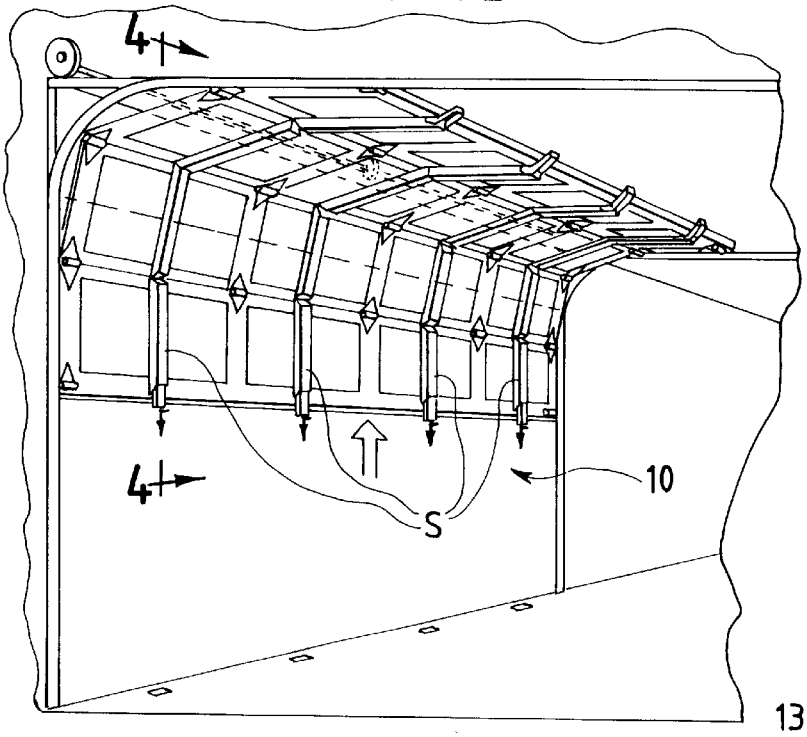
FIG. 2 is a perspective view of the door assembly of FIG. 1, showing the assembly in a raised position.
Figure 2A:
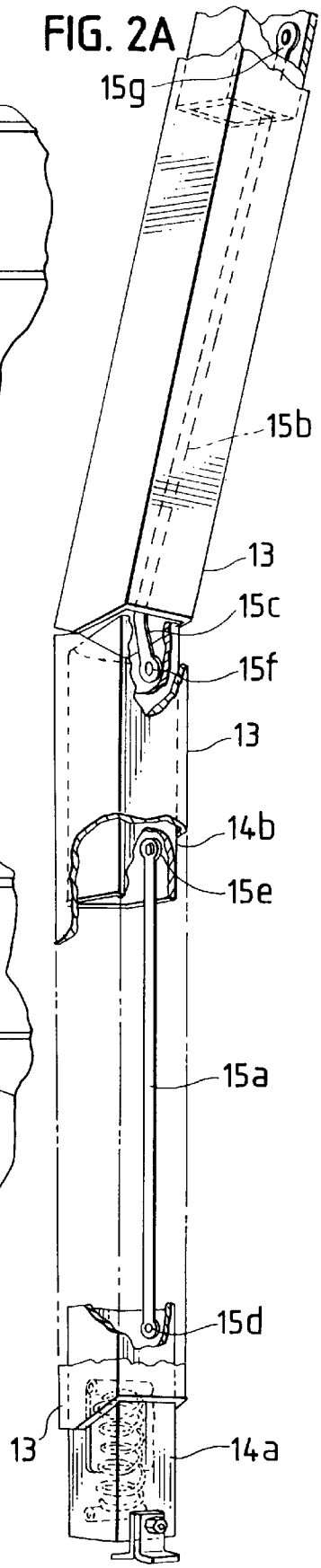
FIG. 2A is a partial perspective view of a lower portion of a support assembly used in the door assembly of the present invention.

Turning now to the drawings and referring first to FIG. 1, a door assembly 10 (a garage door) generally includes an articulated door D mounted to a wall member W by a pair of track assemblies 11 and 12 that support the door D and guide it between lowered (FIG. 1) and raised (FIG. 2) positions. Each of these assemblies 11 and 12 includes a track and a plurality of rollers (not shown) rotatably mounted to edge portions of the articulated door D and sized to roll in the track. The assemblies 11 and 12 lie on opposite sides of the articulated door D along edge portions of an opening defined by the wall member W. They, and the support members described below, are made of steel or any other material of high strength and rigidity.

A plurality of support assemblies S spaced a predetermined distance apart and disposed on the inside face of the door assembly D brace the door assembly when the assembly lies in the lowered position shown in FIG. 1. These assemblies S extend across the door assembly D generally perpendicularly to the horizontal edge portions of the door segments that comprise the door assembly. In this embodiment, the door assembly D includes four support assemblies. However, the door assembly of the present invention may include fewer than the four support assemblies shown or more than four.

Figure 4:
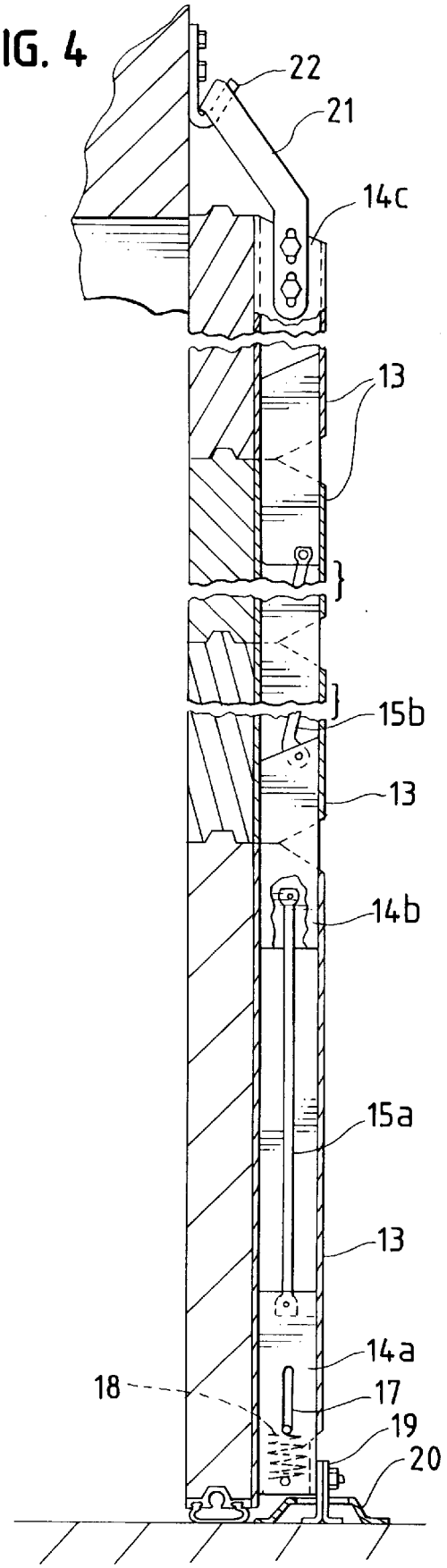
FIG. 4 is a side elevation view of the entire support assembly, showing the support assembly in a lowered position.
Figures 5, 6:
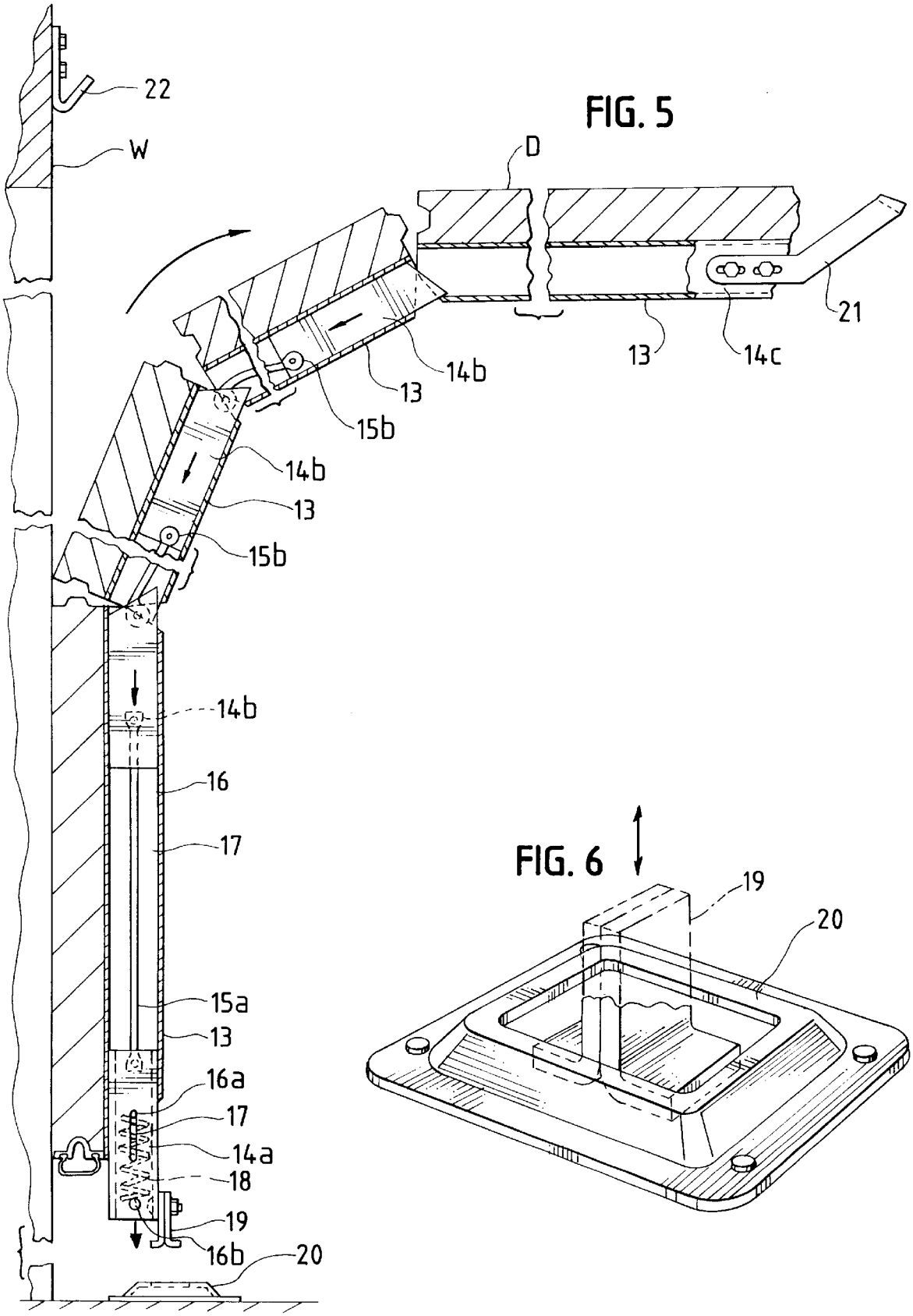
FIG. 5 is a side elevation view of the entire support assembly, showing the support assembly in a raised position.
FIG. 6 is a perspective view of a receiving bracket that receives a lower end of the lower portion of the support assembly.

Each support assembly S includes a plurality of guide members 13 comprising elongate tubes having a generally rectangular cross-sectional configuration. (See FIGS. 2A–5.) These guide members 13 lie in end-to-end relation fixedly secured (e.g., welded, bolted or nailed) to a door segment of the door assembly D. (Each door segment supports one guide member 13 of each assembly S.) They have beveled end portions to allow the door segments to pivot (as shown in FIG. 5) and move between raised and lowered positions.

Figure 3:
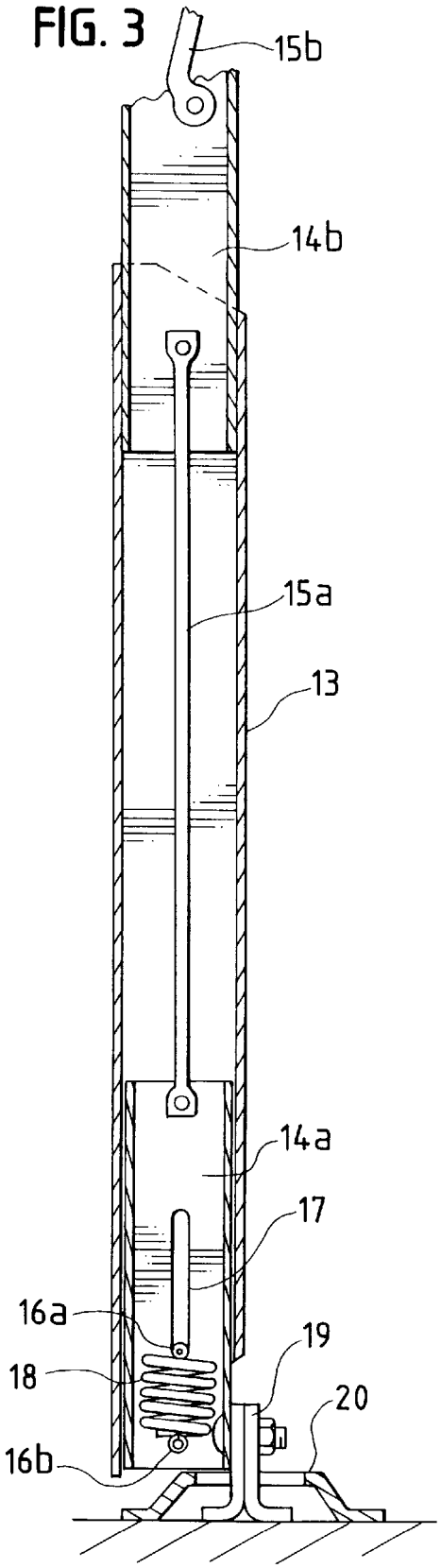
FIG. 3 is a side elevation view of a lower portion of the support assembly used to brace the door assembly and shown in FIGS. 1 and 2.

The guide members 13 receive, in sliding telescopic relation, a plurality of locking members 14, including a bottom locking member 14*a*, a plurality of intermediate locking members 14*b*, and a top locking member 14*c*. The locking members 14 are elongate tubular members with a cross-sectional configuration similar to that of the guide members 13. In place and as shown in FIGS. 3–5, the bottom locking member 14*a* lies at the bottom end of the lowest guide member 13; the intermediate locking members 14*b* lie over adjacent edge portions of adjacent door segments; and the top locking member 14*c* lies at the top end of the top guide member.

A plurality of linking members 15, including a bottom linking member 15*a* and upper linking members 15*b*, connect the locking members 14*a*–14*c* so that the locking members 14*a*–14*c* may move in unison, as described below. The linking members 15*a* and 15*b* are elongate bars that extend between adjacent locking members. The linking member 15*a* is a straight bar while the linking members 15*b* have a slight bend as at 15*c*. One end of the linking member 15*a* lies pivotally connected to the locking member 14*a* as at 15*d*, and an opposite end of the linking member 15*a* lies pivotally connected to the adjacent locking member 14*b* as at 15*e*. One end of each linking member 15*b* lies pivotally connected to a locking member 14*b* as at 15*f*, and an opposite end of each linking member 15*b* lies pivotally connected to an adjacent locking member 14*b* or 14*c* as at 15*g*. Each of the linking members 15*a* and 15*b* has a predetermined length to place the locking members 14*a*–14*c* in position at or proximate the connection between adjacent door segments.

A pin 16*a* extends through the bottom guide tube 13 with its end portions secured (e.g., welded) to opposite wall portions of the bottom tube 13. This pin 16*a* also extends through slots 17 in opposite wall portions of the locking member 14*a* in sliding engagement with the member 14*a*. The pin 16*a* serves as a stop to prevent the set of articulated locking members 14*a*–14*c* from dropping below a first predetermined position. In this first position, the pin 16*a* engages the tops of slots 17 in the locking member 14*a* to stop that member 14*a* and all the other locking members 14*b* and 14*c* disposed above the member 14*a* from sliding out of the guide tubes 13.

A compression spring 18 lies in the bottom locking member 14*a* disposed between the pin 16*a* and a pin 16*b* that lies secured (e.g., welded) to the member 14*a* below the slots 17 and across the central bore defined by the member 14*a*. This spring 18 biases the set of locking members 14*a*–14*c* to assure that the locking members 14*a*–14*c* stay in the first predetermined position shown in FIG. 5. In the first predetermined position the support assemblies S allow the door segments to pivot relative to each other and the door to move upwardly and downwardly between raised and lowered positions.

As the door D moves downwardly towards a fully closed position, a tab segment 19 of the locking member 14*a* enters a pocket defined by a floor plate 20 fixedly secured to the base member. (This floor plate 20 cooperates with the tab 19 to secure bottom edge portions of the bottom door segment to the base member.) Further downward movement of the door brings the tab segment 19 into contact with the floor plate 20 and moves the locking members 14*a*–14*c* and the linking members 15*a* and 15*b* upwardly against the compressive force of the spring 18 to a second predetermined position in which the locking members bridge the connections between adjacent door segments (see FIGS. 3 and 4).

As stated above, the lower locking member 14*a* secures end portions of the bottom door segment to the base member. The top locking member 14*c* includes a bracket portion 21 which engages a hook member 22 to secure the top door segment of the door D to the surrounding wall member W. Conventional securing means, e.g. screws, secure the hook member 22 to the wall member W. (Alternatively, the hook member 22 may be an integral part of the wall member W.)

When the door D moves from a lowered to a raised position, the bracket portion 21 of the top locking member 14*c* moves out of engagement with the hook member 22 and the spring 18 pushes the locking and linking members 14*a*–14*c* and 15*a*–15*c* downwardly until the slots 17 of the bottom locking member 14*a* engages the pin 16 and the locking members move into the first predetermined position, allowing the door segments to pivot relative to each other and the door to move upwardly as shown in FIG. 5. When the door D moves from a raised to a lowered position, the hook member 22 engages the bracket portion 21; and the tab segment 19 moves into the bracket 20, as described above (FIGS. 3 and 4).

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. In a door assembly having articulated segments disposed in end to end relation and being movable between raised and lowered positions to open or close an opening defined by a wall member or a wall member and a base, a support assembly including: a plurality of guide members disposed in spaced end-to-end relation and secured to the door segments; a plurality of articulated locking members disposed in end-to-end relation with each other and in sliding relation with the guide members and connected to each other to move in unison in relation to the guide members; and positioning means for limiting the movement of the locking members between a first predetermined position in which the locking members allow the door segments to pivot in relation to one another as the door assembly moves from a lowered to a raised position and a second predetermined position in which each locking member bridges adjacent door segments, a door segment and the wall member, or a door segment and the base; the guide members and locking members cooperating in the second predetermined position to define a rigid column for limiting displacement of the door segments in directions normal to the interior and exterior faces of the door segments.

2. The door assembly of claim 1, wherein the positioning means includes a stop portion of one of the guide members, said stop portion engaging a locking member to limit the movement of said locking member.

3. The door assembly of claim 1, wherein each guide member and each locking member comprises an open ended tube.

4. In a door assembly for opening or closing an opening defined by a wall member or a wall member and a base and having articulated segments disposed in end to end relation, a support assembly including: a plurality of guide members, each guide member being secured to a separate door segment; a plurality of locking members disposed in spaced, end-to-end relation with each other and in sliding engagement with the guide members; a plurality of linking members for connecting the locking members together, each linking member being pivotally mounted at one end to a locking member and at an opposite end to an adjacent locking member; positioning means for limiting the movement of the locking and linking members between a first predetermined position in which the locking members allow the door segments to pivot in relation to one another and a second predetermined position in which each locking member bridges adjacent door segments, a door segment and the wall member, or a door segment and the base.

5. The door assembly of claim 4, wherein the positioning means includes a stop portion of one of the guide members, said stop portion engaging a locking member to limit the movement of said locking member.

6. The door assembly of claim 5, wherein the positioning means further includes a spring member for biasing the locking members to the first predetermined position.

7. The door assembly of claim 4, wherein each guide member and each locking member comprises an open ended tube.

8. In a door assembly having articulated segments disposed in end to end relation and being movable between raised and lowered positions to open or close an opening defined by a wall member or a wall member and a base, a support assembly for bracing the door segments, said support assembly including: a plurality of tubular guide members disposed in spaced, end-to-end relation, each tubular guide member being fixedly secured to a separate door segment; a plurality of tubular locking members disposed in sliding and telescoping relation with the guide members; a plurality of linking members for connecting the locking members together, each linking member being pivotally mounted at one end to a locking member and at an opposite end to an adjacent locking member; positioning means for limiting the movement of the locking and linking members between a first predetermined position, allowing the door segments to pivot in relation to one another as the door assembly moves from a lowered to a raised position and a second predetermined position in which each locking member bridges adjacent door segments, a door segment and the wall member, or a door segment and the base; the plurality of locking members including a bottom locking member with a tab segment for extending into a groove in the base or wall member and a top locking member with a bracket portion that interlocks with a hook in the wall member when the support assembly lies in the second predetermined position.

9. The door assembly of claim 8, wherein the positioning means further including a stop portion of one of the guide members, said stop portion engaging a locking member to limit the movement of said locking member.

10. The door assembly of claim 8, wherein the positioning means further includes a spring member for biasing the locking members to the first predetermined position.

11. The door assembly of claim 8, wherein each locking member and each guide member comprises an open ended tube.

12. The door assembly of claim 8, wherein a plurality of support assemblies brace the door segments.

13. In a door assembly having articulated segments disposed in end to end relation and being movable between raised and lowered positions to open or close an opening defined by a wall member or a wall member and a base, a support assembly including: a plurality of guide members disposed in spaced end-to-end relation and secured to the door segments; a plurality of articulated locking members disposed in end-to-end relation with each other and in sliding relation with the guide members; positioning means for limiting the movement of the locking members between a first predetermined position in which the locking members allow the door segments to pivot in relation to one another as the door assembly moves from a lowered to a raised position and a second predetermined position in which each locking member bridges adjacent door segments, a door segment and the wall member, or a door segment and the base; the positioning means including a spring member for biasing the locking members to the first predetermined position and a stop portion of one of the guide members, said stop portion engaging a locking member to limit the movement of said locking member.

14. In a door assembly having articulated segments disposed in end to end relation and being movable between raised and lowered positions to open or close an opening defined by a wall member or a wall member and a base, a support assembly including: a plurality of guide members disposed in spaced end-to-end relation and secured to the door segments; a plurality of articulated locking members disposed in end-to-end relation with each other and in sliding relation with the guide members and connected to each other to move in unison in relation to the guide members; and positioning means for limiting the movement of the locking members between a first predetermined position in which the locking members allow the door segments to pivot in relation to one another as the door assembly moves from a lowered to a raised position and a second predetermined position in which each locking member bridges adjacent door segments, a door segment and the wall member, or a door segment and the base.

15. The door assembly of claim 14, wherein the positioning means includes a stop portion of one of the guide members, said stop portion engaging a locking member to limit the movement of said locking member.

16. The door assembly of claim 14, wherein each guide member and each locking member comprises an open ended tube.

* * * * *